US007967103B2

(12) United States Patent
Bothe

(10) Patent No.: US 7,967,103 B2
(45) Date of Patent: Jun. 28, 2011

(54) LATCHING CONNECTION FOR AN ARRANGEMENT COMPRISING A PLURALITY OF LOUDSPEAKER BOXES HANGING ONE ABOVE THE OTHER

(75) Inventor: Frank Bothe, Banknang (DE)

(73) Assignee: d&b audiotechnik GmbH, Backnang (DE)

( * ) Notice: Subject to any disclaimer, the term of this patent is extended or adjusted under 35 U.S.C. 154(b) by 1441 days.

(21) Appl. No.: 11/436,056

(22) Filed: May 18, 2006

(65) Prior Publication Data

US 2007/0000719 A1 Jan. 4, 2007

(30) Foreign Application Priority Data

May 18, 2005 (DE) ..... 10 2005 022 869

(51) Int. Cl.
*A47B 46/00* (2006.01)
*A47B 57/04* (2006.01)

(52) U.S. Cl. ..... 181/199; 181/30; 381/386

(58) Field of Classification Search ..... 181/30, 181/199, 287; 211/194, 106.01; 312/198, 312/107.111; 292/101, 218, 296, 297; 403/330; 108/64; 381/386, 388
See application file for complete search history.

(56) References Cited

U.S. PATENT DOCUMENTS

| | | | | |
|---|---|---|---|---|
| 5,000,286 | A | 3/1991 | Crawford et al. | |
| 5,602,366 | A * | 2/1997 | Whelan et al. | 181/144 |
| 5,714,723 | A | 2/1998 | Kang | |
| 5,819,959 | A * | 10/1998 | Martin | 211/118 |
| 5,996,728 | A | 12/1999 | Stark | |
| 6,425,563 | B1 * | 7/2002 | Mihailoff | 248/245 |
| 6,464,423 | B1 * | 10/2002 | Klein | 403/322.4 |
| 6,536,554 | B2 * | 3/2003 | Andrews et al. | 181/199 |
| 6,640,924 | B2 * | 11/2003 | Messner | 181/144 |
| 2002/0071580 | A1 | 6/2002 | Engebretson et al. | |
| 2002/0153195 | A1 | 10/2002 | Messner | |
| 2003/0231782 | A1 * | 12/2003 | Engebretson et al. | 381/182 |
| 2004/0155160 | A1 * | 8/2004 | Welch et al. | 248/218.4 |
| 2004/0213425 | A1 * | 10/2004 | Simidian et al. | 381/335 |
| 2005/0008165 | A1 * | 1/2005 | Sack et al. | 381/59 |

FOREIGN PATENT DOCUMENTS

| | | |
|---|---|---|
| DE | 40 25 627 | 2/1991 |
| DE | 40 25 627 A1 | 2/1991 |
| DE | 20 2004 014 U1 | 12/2004 |
| EP | 1 143 765 A2 | 10/2001 |

* cited by examiner

*Primary Examiner* — Jeremy Luks
(74) *Attorney, Agent, or Firm* — Staas & Halsey LLP

(57) ABSTRACT

An attachment apparatus for forming an arrangement comprising a plurality of loudspeaker boxes hanging one above the other comprises a latching connection by means of which two loudspeaker boxes which are adjacent in the arrangement can be connected together at a pre-selectable angle.

12 Claims, 3 Drawing Sheets

LATCHING CONNECTION FOR AN ARRANGEMENT COMPRISING A PLURALITY OF LOUDSPEAKER BOXES HANGING ONE ABOVE THE OTHER

Latching connection for an arrangement comprising a plurality of loudspeaker boxes hanging one above the other The invention relates to a attachment apparatus for forming an arrangement comprising a plurality of loudspeaker boxes hanging one above the other, to an arrangement comprising a plurality of loudspeaker boxes hanging one above the other, and to a method for forming an arrangement comprising a plurality of loudspeaker boxes hanging one above the other.

Arrangements comprising loudspeaker boxes hanging one above the other have been increasingly used recently to provide sound in listener areas in large gatherings. These are also referred to as line arrays. FIG. 1 illustrates a typical line array 1 according to the prior art. The line array 1 is formed from a large number of loudspeaker systems or boxes 2, and the housings are each attached to one another at a precisely defined intermediate angle. The overall arrangement is suspended and aligned on a so-called fly frame 5. The vertical profile of the resultant wavefront—governed by the angles between the individual loudspeaker boxes 2—predetermines the sound level distribution in the listener area. In order to configure this variably, connecting elements are provided between the individual housings, which on the one hand must ensure that the individual housings are held together securely because of the high loads that occur, while on the other hand they must allow variability of the intermediate angle setting. Furthermore, for cost reasons, short installation and disassembly times are of considerable importance for the fitting and removal work for such line arrays 1. In addition, care should be taken to ensure that attachment systems for line arrays 1 are intended to be cost-effective and must satisfy stringent safety requirements, in which case, in particular, the risk of accidents during fitting and removal must also be kept as low as possible.

Normally, the housings or loudspeaker boxes 2 are connected to one another in the front area by means of hinged connecting elements 3 which are provided on both sides of the loudspeaker boxes 2—for example a rotating journal which is anchored in one loudspeaker housing and a perforated metal sheet which is anchored in the loudspeaker housing and holds the rotating journal. The hinged connecting elements in each case define the rotation axis between a pair of loudspeakers. The intermediate angle (the angle between the emission axes of adjacent loudspeaker boxes) is normally adjusted in the rear area of the loudspeaker boxes 2, where the loudspeaker boxes 2 are normally equipped with perforated metal sheets 4 fitted at the side. In order to fix the loudspeaker boxes 2 to one another at the desired intermediate angle, the loudspeaker boxes 2 must be aligned with respect to one another and must be fixed in their relative position with respect to one another by insertion of a strain bolt through a suitable pair of holes in two perforated metal sheets 4.

This system has the disadvantage that fitting and removal are complex. Fitting/removal on the hanging system is difficult and hazardous, since the strain bolts must be inserted and removed under load (the weight of the loudspeaker boxes). Furthermore, during installation, it is not possible to preselect an intermediate angle in a state that has not yet been fixed.

Furthermore, various connection solutions are known in which the rear connecting element 4 is in the form of an adjustable stop. The intermediate angle can be preselected by adjustment of the stop, before the loudspeaker boxes 2 are hung on one another or are raised on their front hinged connecting elements 3. Once the loudspeaker boxes 2 have been connected in the front area via the hinged connecting elements 3, they hang downwards in a straight line (the intermediate angle is 0°). The curvature of the line array 1 is now provided via a strap, which is fitted to the lowermost loudspeaker box 2 and is passed upwards on the rear face of the line array 1 (for example towards the fly frame 5). The line array 1 is curved by tightening this strap, until the limit position is reached by the effect of the stops between the loudspeaker boxes 2. This system has the advantage that the intermediate angle or angles at which the loudspeaker boxes 2 are intended to be aligned with respect to one another can be preselected. However, the disadvantage is that the strap results in a requirement for an additional attachment element and, with the tightening of the strap, an additional installation step.

A further known attachment system likewise uses a stop for the rear connecting elements 4, but this defines the minimum possible intermediate angle (the maximum possible intermediate angle is predetermined by the trapezoidal cross section of the housings 2) —in contrast to the situation with the system described above. This system has the disadvantage that it can typically be used only with relatively short line arrays 1 since, in the case of long line arrays 1 and/or sharp curvature (not only tensile forces, but (also shear forces can occur in the area of the rear connecting elements 4, for which an angle stop such as this is ineffective.

The invention is based on the object of providing an attachment apparatus for forming an arrangement comprising a plurality of loudspeaker boxes hanging one above the other, which allows simple, time-saving and at the same time safe fitting/removal of the arrangement (for example a line array). A further aim of the invention is to specify methods for forming an arrangement comprising a plurality of loudspeaker boxes hanging one above the other, which satisfy the above requirements.

The object on which the invention is based is achieved by the features of the independent claims. Advantageous refinements and developments of the invention are specified in the dependent claims.

According to claim 1, the attachment apparatus according to the invention for forming the arrangement comprising loudspeaker boxes hanging one above the other has a latching connection by means of which two loudspeaker boxes which are adjacent in the arrangement can be connected together. The particular advantage of the latching connection is that the connection is formed automatically as a result of the latching. The connection can therefore be made both when subject to a load (that is say when loudspeaker boxes are being fitted to a system that has already been suspended), and without any load, without difficulties. This reduces the installation time, allows different installation procedures and reduces the risk of accidents during fitting/removal.

According to one particularly advantageous refinement of the invention, the latching connection is designed such that the two loudspeaker boxes which are adjacent in the arrangement can be connected together at a preselectable angle. This allows preselection of a desired angular position, at which the latching engagement is formed automatically.

One advantageous refinement of the invention is characterized in that the latching connection has a latching hook, which is mounted on a loudspeaker box, and a holding element which is mounted on another loudspeaker box and interacts with the latching hook. In this case, the attachment apparatus preferably has a profiled part which is provided with a hole grid, with the holding element being a strain bolt which can be inserted into holes in the hole grid.

The latching hook is preferably fitted to the profiled part such that it can pivot, so that the profiled part is used both for attachment of the holding element and for attachment of the latching hook.

One further advantageous refinement of the invention is characterized in that the latching connection can be secured in the latched-in state by means of a mechanical securing element against becoming loose from the latched position. The mechanical securing element makes it possible for the latching connection to also absorb shear forces (which act in the direction of increasing intermediate angle), thus extending the design capability for the arrangement comprising loudspeaker boxes which are arranged hanging one above the other. For example, the securing element may be in the form of a securing bolt which can be inserted into a securing hole, which is provided in the hook area of the latching hook, and interact with holes in the hole grid in the profiled part.

In a first preferred method for forming an arrangement comprising a plurality of loudspeaker boxes hanging one above the other and using the attachment apparatus according to the invention, the loudspeaker boxes are hung one by one on the already hanging, partially constructed arrangement comprising a plurality of loudspeaker boxes hanging one above the other. The method is characterized by the steps of hanging one (each) loudspeaker box for example on its front area on the currently lowermost loudspeaker box in the partially constructed arrangement (or the uppermost loudspeaker box on the fly frame), and by the loudspeaker box which has been attached then being raised on its rear area until the latching connection latches in. This makes it possible to install an arrangement such as this in a simple floating manner without any additional aids, such as straps etc.

In a further method for forming an arrangement comprising a plurality of loudspeaker boxes hanging one above the other and using the attachment apparatus according to the invention, groups of loudspeaker boxes are initially installed in a stand (that is to say not hanging), and the groups of initially installed loudspeaker boxes are then hung group by group on the already hanging, partially constructed arrangement comprising a plurality of loudspeaker boxes hanging one above the other. The method is characterized by the steps of stacking one above the other of the loudspeaker boxes which are to be initially installed in a group, hinged connection of them, for example in their front area, hanging of the-uppermost loudspeaker box of the initially installed stack (that is to say the group) of loudspeaker boxes for example on its front area on a fly frame or on the lowermost loudspeaker box in the partially constructed arrangement, the formation of the latching connection between the fly frame or the lowermost loudspeaker box of the partially constructed arrangement and of the uppermost loudspeaker box of the stack of loudspeaker boxes, and the formation of the latching connections within the stack of loudspeaker boxes. This method variant profits from the automatic formation of the latching connections between the loudspeaker boxes in the stack during raising or lifting of the initially installed group of loudspeaker boxes.

The invention will be explained in more detail in the following text using one exemplary embodiment and with reference to the drawings, in which.

Figure 1:
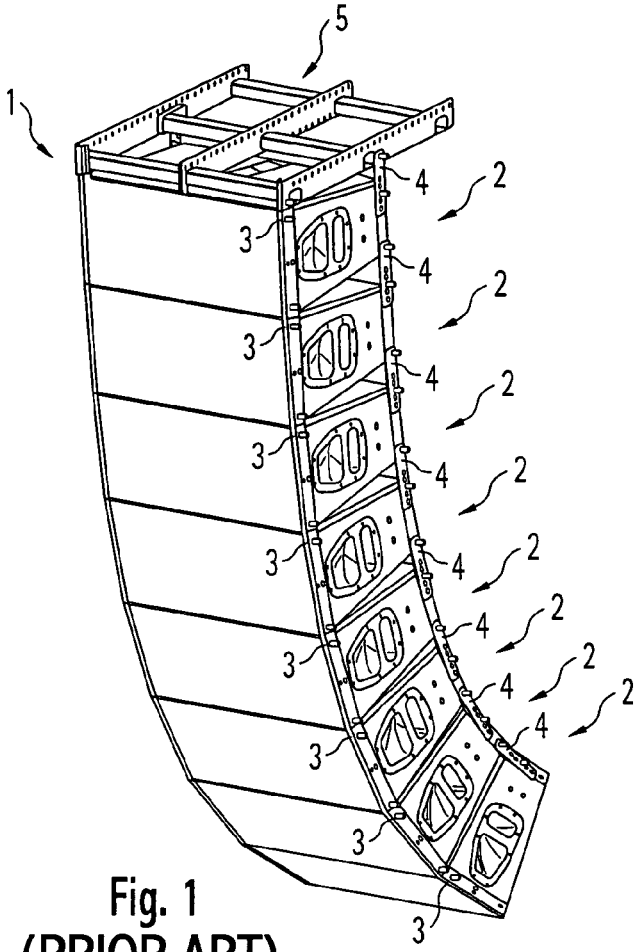
Fig. 1 (PRIOR ART)
FIG. 1 shows a perspective view of a line array with a fly frame and with loudspeaker boxes attached to it.
Figure 7:
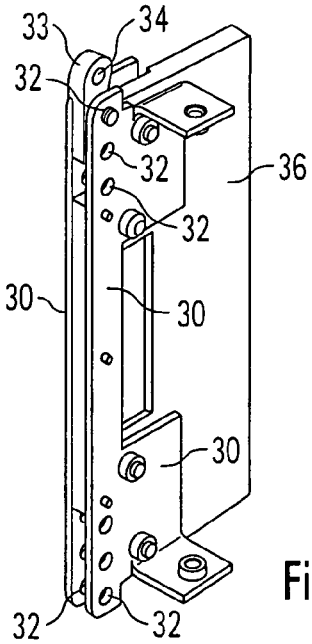
FIG. 7 shows a perspective illustration of a fitting part on the front area of the loudspeaker box.
Figure 3:
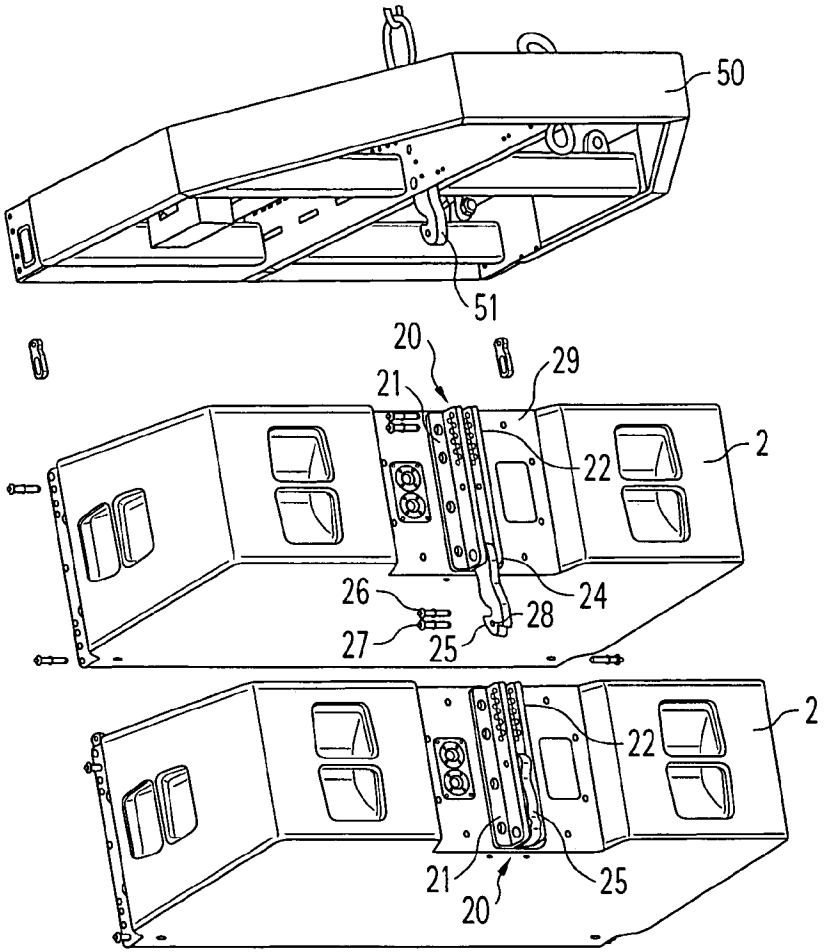
FIG. 3 shows an exploded illustration of the fly frame and of two loudspeaker boxes, from the rear.
Figure 2:
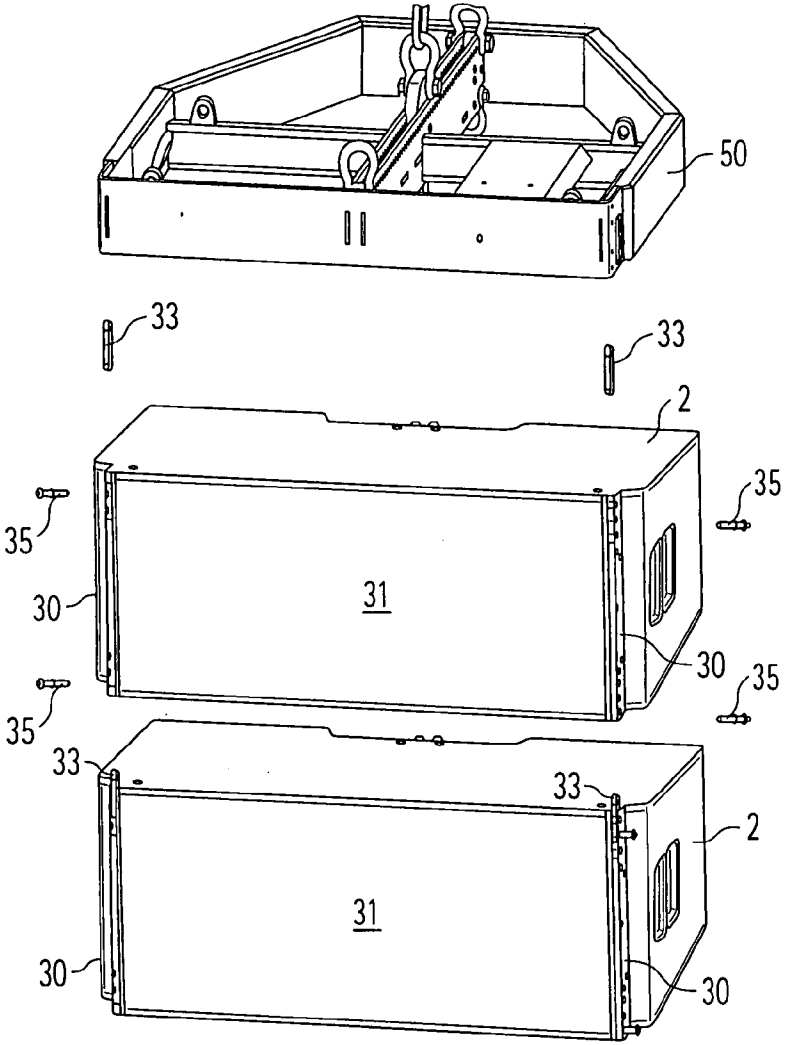
FIG. 2 shows an exploded illustration of the fly frame and of two loudspeaker boxes, from the front.
Figure 4:
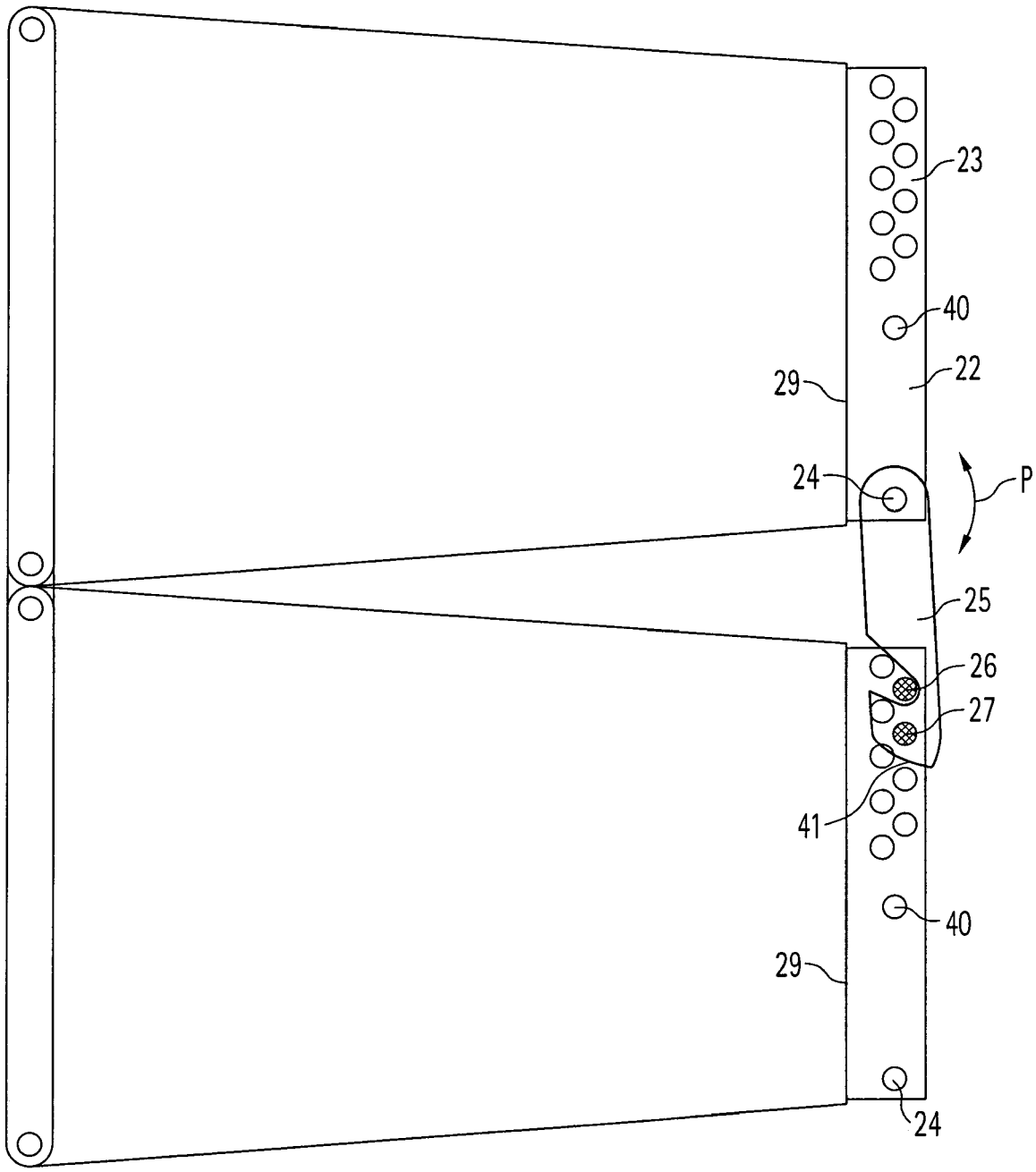
FIG. 4 shows a cross-sectional illustration of two loudspeaker boxes with an attachment apparatus latched in and secured in the rear area of the loudspeaker boxes.

According to invention, loudspeaker boxes 2 as shown in FIGS. 2 and 3 based on the linear arrangement shown in FIG. 1 (a line array comprising a row of loudspeaker boxes 2 which are arranged hanging one above the other) are hung on a fly frame 5. Two parallel-running sheet-steel strips 30 are in each case provided in the front area of the loudspeaker boxes 2, on both side edges of a loudspeaker box 2, and extend at the side adjacent to the front face (emission area 31) of the loudspeaker box 2 over the vertical dimension of the loudspeaker box 2. The sheet-steel strip pairs 30 each hold one housing side wall 36 of the loudspeaker box 2, and are firmly connected to it. The sheet-steel strip pairs 30 have attachment holes 32 at their ends, as can be seen in FIG. 7. A lug 33 with a bearing eye 34 can be mounted on the attachment holes 32. The lug 33 with the bearing eye 34 projects beyond the upper face of the loudspeaker box 2. For hinged connection of two loudspeaker boxes 2, the two lugs 33 of the lower loudspeaker box are positioned at the lower end of the sheet-metal strips 30 of the lower loudspeaker box 2 located above it and one bearing bolt 35 is in each case passed through the bearing eye 34 on the sheet-steel strip pair 30 of the lower loudspeaker box 2, and the attachment holes 32 in the sheet-steel strip pair 30 of the upper loudspeaker box 2. This connection in the front area defines the pivoting axis between the two loudspeaker boxes 2. The front connection between the fly frame 5 and the uppermost loudspeaker box 2 is made in a corresponding manner. In addition to the connection of the loudspeaker boxes 2 in the front area as described here, other connecting mechanisms may also be used which allow the loudspeaker boxes 2 to pivot relative to one another. In particular, quadrilateral tubes or U-profiles mounted on the housing of the loudspeaker box 2 can also be used, in particular, instead of the sheet-steel strip pairs 30, in which case a hinge element with two attachment limbs connected via a joint is then pushed or inserted into mutually opposite quadrilateral tubes or U-profiles and is locked on its attachment limbs on both sides by means of strain bolts. In this case, the rotation axis is provided by the joint in the hinge element rather than by the strain bolts.

As shown in FIGS. 3 to 6, each loudspeaker box 2 has a high-strength profile 20 on its rear face with a broad baseplate 21 and a double web 22. The baseplate 21 is firmly anchored on the rear wall 29 of the loudspeaker box 2. The double web 22 forms the limb of a U and is in the form of a double hole grid 23 in the upper area. Furthermore, there are two opposite bearing holes 24 in the lower area of the double web 22.

Figure 5:
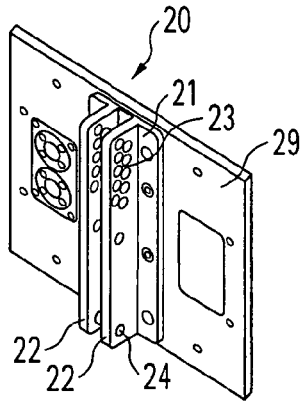
FIG. 5 shows a perspective view of a U-shaped attachment profile on the rear face of a loudspeaker box.

The bearing holes 24 are used for mounting a latching hook 25 such that it can pivot (not illustrated in FIG. 5). The latching hook 25 can be pivoted through about 180° as shown by the arrow P in FIG. 4. In a transport position (see FIG. 3, lower loudspeaker box 2), the latching hook 25 is pivoted upwards, and is stowed between the two double webs 22. In its latched position (see FIG. 4), in which it is pivoted out downwards, the latching hook 25 projects beyond the lower face of the loudspeaker box 2. In this case, in its latched position, the latching hook 25 clasps a strain bolt 26 which has previously been inserted through a hole pair in the double hole grid 23 in the double web 22 of a loudspeaker box 2 which is located under the loudspeaker box 2 to which the latching hook 25 is fitted. In order to prevent the latching connection from becoming loose, a securing bolt 27 is provided, is pushed through a further hole pair in the double hole grid 23 and through a hole 28 that is provided for this purpose in the hook area of the latching hook 25 remote from the bearing, and securely locks the latching connection. The securing bolt 27 also results in the latching connection being able to absorb and pass on not only tensile forces but also (high) shear forces.

The double hole grid 23 may, for example, have two or more rows of holes, with the distance between the holes being chosen such that, on the one hand, it is possible to guarantee the required robustness of the profile 20 and, on the other hand, allow a sufficiently fine angular adjustment capability. Holes in the outer row of holes or in the inner row of holes in the double hole grid 23 can optionally be used for the strain bolt 26 and the securing bolt 27.

It should be noted that a T-shaped profile with a single web can also be used instead of the U profile 20 with a double web 22. In this case, by way of example, the latching hook 25 can be designed with a longitudinal slot for the single web.

The latching hook 25 is preferably locked in its transport position by means of a securing pin. The hole for the securing pin is denoted by the reference symbol 40 in FIG. 4. This ensures that the latching hook 25 is not damaged during transportation, and cannot cause damage/injuries. In order to produce a latching connection, the securing pin is removed and the latching hook 25 is folded out of its transport position. As a consequence of the force of gravity, the latching hook 25 falls against a stop (not illustrated) which is provided on the profile 20 of the upper loudspeaker box 2 and results in the latching hook 25 resting in a defined position (see FIG. 3, upper loudspeaker box 2). If the lower loudspeaker box 2, which is hinged in the front area, is now moved towards the upper loudspeaker box 2 by means of a pivoting movement, the strain bolt 26 engages with the end inclined surface area 41 (which acts as a striking surface) of the latching hook 25 and in the process raises the latching hook 25 from its seat. The inclined surface area 41, which is oriented at an acute angle with respect to the longitudinal extent of the latching hook 25, may extend essentially over the entire end face of the latching hook 25. The latching-in process then takes place as a consequence of the force of gravity by the latching hook 25 falling back over the strain bolt 26 as soon as the desired intermediate angle is reached.

The latching hook 25 can also be prestressed via a spring mechanism (not illustrated) such that, on the one hand, it remains in its transport position and, on the other hand, in its folded-out rest position—after being folded out manually (see FIG. 3, upper loudspeaker box 2) against the stop (not illustrated), that is to say it is pushed in the direction of the rear wall 29 of the loudspeaker housing 2 of the lower loudspeaker box 2. In consequence, the latching hook 25 is likewise secured during transportation and, furthermore, the prestressing secures the defined rest position of the latching hook 25 (and thus ensures that the latching connection latches in automatically), even in the case in which the loudspeaker box 2 is being installed with the emission direction pointing slightly upwards.

Figure 6:
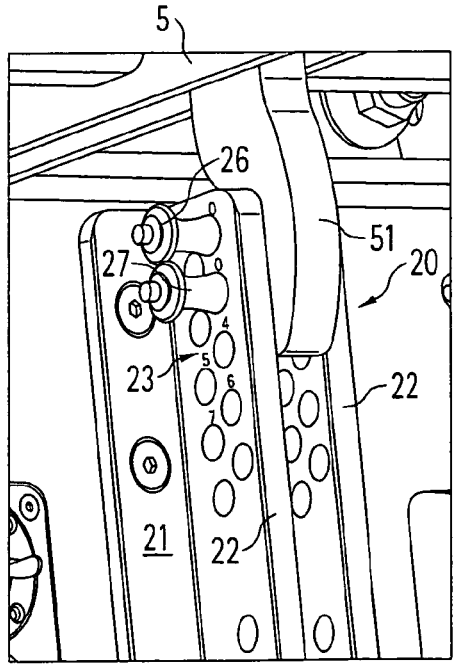
FIG. 6 shows a perspective view of the latching connection between the fly frame and the uppermost loudspeaker box attached to it.

FIGS. 3 and 6 show the connection between the fly frame 5 and the uppermost loudspeaker box 2. The fly frame 5 has a latching hook 51 in its rearward area, which may be designed identically to the latching hook 25. As can be seen in FIG. 6, this latching hook 51 is attached in the same way as the latching hook 25 by means of a strain bolt 26 and a securing bolt 27 on the double web 22 of the U profile 20.

It should be noted that the latching connection according to the invention may be modified in many ways. For example, a different latching part may be provided instead of a latching hook, for example a toothed rod with latching teeth fitted at the side or at the front and/or rear face, and a moving blocking claw instead of the strain bolt 26 with a complementary tooth system. A capability to preselect the angular position may in this case be achieved, for example, by means of an adjustable stop for the tooth rod. It should also be noted that the latching connection need not necessarily be provided in the rear area of the loudspeaker boxes 2. In principle, it is also feasible for the rotation axis to be arranged between adjacent loudspeaker boxes 2 in the area of the housing rear face and for latching connections according to the invention to be provided in the front area of the loudspeaker boxes (instead of the sheet-steel strip pairs 30) in order to ensure that adjacent loudspeaker boxes are spread apart at the correct angle. Furthermore, it should be noted that, instead of that described in the exemplary embodiment, with one latching connection per loudspeaker. box 2 according to the invention, it is also possible to provide two or more latching connection runs.

The individual loudspeaker boxes 2 may weigh, for example, 60 kg. By way of example, the dimensions of the loudspeaker boxes 2 may be 110 cm×36 cm×58 cm (width×height×depth). The fly frame 5 may be designed for a system load of 1.5 t with a safety factor of 10. The hole grid 23 may be of such a size that it is possible to define an intermediate angle between the loudspeaker boxes 2 in the range from 0° to 7° in 1° steps. The trapezoidal cross section of the loudspeaker boxes 2 may be of such a size that the upper face and lower face of adjacent loudspeaker boxes 2 include a housing angle of 7.5° with an intermediate angle of 0° (parallel emission). The sizes of all of the connecting elements 20, 21, 22, 23, 24, 25, 26, 27, 51 are such that tensile and compressive loads of 20 kN per element are ensured with a safety margin of 5. The line array 1 may be fitted with more than 10, and in particular more than 20, loudspeaker boxes 2.

According to a first embodiment variant, it is possible to fit the loudspeaker boxes 2 one by one. This is done in such a way that the loudspeaker boxes 2 are first of all "initially pinned", that is to say the strain bolts 26 are inserted into the desired mounting holes in the double hole grid 23 in the double web 22. The line array 1 is then formed from top to bottom by successive hanging of loudspeaker boxes 2. For this purpose, each loudspeaker box 2 is first of all hung in at the front (on the sheet-steel strip 30) and is then raised at the rear until the latching hook 25 automatically latches into the preselected angular position. The securing bolt 27 is then inserted, thus resulting in a rigid connection on the rear face of the line array 1, which also has no problem with shear forces.

One alternative design variant comprises the loudspeaker boxes 2 being initially installed in groups of suitable size on the floor (that is to say not in the hanging state), and the initially installed groups then being suspended successively. First of all, the loudspeaker boxes 2 are initially pinned in the already described manner. Four loudspeaker boxes 2 are then, for example, in each case stacked one above the other on a carriage or roller board, and are connected to one another at the front, hinged connecting elements 30, 33, 35. Since the for example four loudspeaker boxes 2 in one group are located with one housing on top of another thus resulting in a curved housing stack corresponding to the housing angle (for example 7.5°), it is advantageous for the carriage/roller board to be wedge-shaped, in order to counteract the inclination of the housing stack. The latching hook 25 is located in its folded-down position. The initially installed group of loudspeaker boxes 2 is then suspended at the front (on the sheet-steel strip pairs 30 of the uppermost loudspeaker box 2) on the fly frame 5 or on the lowermost loudspeaker box 2 of the partially constructed line array 1. If possible, the rear-face latching connection is now formed between the fly frame 5 or the lower loudspeaker box 2 of the partially completed line array 1 and the uppermost loudspeaker box 2 of the initially installed loudspeaker group, for example by slightly lowering the fly frame 5. The fly frame 5 is then raised, as a result of which the latching connections are produced one after the other within the loudspeaker group. An alternative possible way to produce the individual latching connections within the group of initially installed loudspeaker boxes 2 is, once this group has been suspended on the fly frame 5 or. on the lowermost loudspeaker box 2 of the partially constructed line array 1, for each individual loudspeaker box 2 in the group to be somewhat raised, on its rear face, starting with the uppermost loudspeaker box 2, until the corresponding latching connection is produced with the loudspeaker box 2 located above it. In this way, the loudspeaker boxes 2 in the group are successively fixed from top to bottom in the desired angular position on the line array 1.

The securing bolts 27 are then inserted in the already described manner.

The invention claimed is:

1. Attachment apparatus for forming an arrangement comprising:

a plurality of loudspeaker boxes hanging one above the other, including first and second loudspeaker boxes;

a latching hook having a first portion which is pivotably fastened to the first loudspeaker box and having a second portion which is designed as a hook element;

a holding element mounted on the second loudspeaker box and interacting with the hook element of the latching hook of the first loudspeaker box to attach the second loudspeaker box to the first loudspeaker box; and a profiled part which is provided with a hole grid and mounted on the second loudspeaker box, the holding element being a strain bolt which can be inserted into holes in the hole grid, the profiled part being in the form of a U-profile with hole grids in profile limbs of the U-profile.

2. Attachment apparatus according to claim 1, wherein the latching hook is designed such that two of the plurality of loudspeaker boxes which are adjacent in the arrangement can be connected together at a preselectable angle.

3. Attachment apparatus according to claim 1, wherein the latching hook is pivotably fitted to the profiled part.

4. Attachment apparatus according to claim 1 or 2, wherein, the latching hook is secured in a latched-in state by a mechanical securing element against becoming loose from the latched position, and is designed to absorb shear forces.

5. Attachment apparatus according to one of claim 1 wherein the latching hook is secured in the position in which it is latched to the holding element by a securing bolt, which can be inserted into holes in the hole grid, against becoming loose from the latched position.

6. Attachment apparatus according to claim 5, wherein the latching hook is provided with a hole for the securing bolt.

7. Attachment apparatus according to claim 1, wherein, the latching hook has an inclined surface area at an outer portion of the latching hook, which acts as a striking surface for operation of the latching hook.

8. Arrangement comprising: a plurality of loudspeaker boxes hanging one above the other, which has at least two loudspeaker boxes arranged one above the other and connected to one another in particular in the front area via a hinged joint and connected in particular on the rear face via at least one attachment apparatus according to claim 1 or 2.

9. Arrangement comprising:

a plurality of loudspeaker boxes hanging one above the other according to claim 5, wherein the first and second loudspeaker boxes are connected to one another in particular on the rear face via a plurality of attachment apparatuses.

10. Attachment apparatus according to claim 1, wherein the first loudspeaker box is arranged above the second loudspeaker box.

11. Attachment apparatus according to claim 1, wherein a mounting angle between the first and second loudspeaker boxes is defined by a position of the holding element, wherein the holding element can be arranged at that position before the latching hook interacts with the holding element.

12. Attachment apparatus for forming an arrangement comprising:

a plurality of loudspeaker boxes hanging one above the other, including first and second loudspeaker boxes;

a latching hook having a first portion which is pivotably fastened to the first loudspeaker box and having a second portion which is designed as a hook element;

a holding element mounted on the second loudspeaker box and interacting with the hook element of the latching hook of the first loudspeaker box to attach the second loudspeaker box to the first loudspeaker box; and a profiled part which is provided with a hole grid and mounted on the second loudspeaker box, the holding element being a strain bolt which can be inserted into holes in the hole grid, the latching hook being secured in the position in which it is latched to the holding element by a securing bolt, which can be inserted into holes in the hole grid, loose from the latched position.

* * * * *

UNITED STATES PATENT AND TRADEMARK OFFICE

CERTIFICATE OF CORRECTION

PATENT NO. : 7,967,103 B2
APPLICATION NO. : 11/436056
DATED : June 28, 2011
INVENTOR(S) : Frank Bothe It is certified that error appears in the above-identified patent and that said Letters Patent is hereby corrected as shown below:

ON THE TITLE PAGE:

Item (75) (Inventor), Line 1, delete “Banknang” and insert -- Backnang --, therefor.

IN THE CLAIMS:

Column 8, Line 25, In Claim 9, delete “claim 5,” and insert -- claim 8, --, therefor.

Column 8, Line 53, In Claim 12, after “grid,” insert -- against becoming --.

Signed and Sealed this
Fourth Day of September, 2012

David J. Kappos

David J. Kappos
*Director of the United States Patent and Trademark Office*